US007612637B2

(12) United States Patent
Zhao

(10) Patent No.: US 7,612,637 B2
(45) Date of Patent: Nov. 3, 2009

(54) BUILT-IN CROSS-COUPLED DIELECTRIC FILTER

(75) Inventor: Yuqing Zhao, Zhangjiagang (CN)

(73) Assignee: Caiqin Electronics Elements Co., Ltd., Jiangsu (CN)

( * ) Notice: Subject to any disclaimer, the term of this patent is extended or adjusted under 35 U.S.C. 154(b) by 98 days.

(21) Appl. No.: 11/822,233

(22) Filed: Jul. 3, 2007

(65) Prior Publication Data

US 2008/0018418 A1 Jan. 24, 2008

(30) Foreign Application Priority Data

Jul. 21, 2006 (CN) ..... 2006 1 0041057

(51) Int. Cl.
*H01P 1/205* (2006.01)
*H01P 7/04* (2006.01)

(52) U.S. Cl. ..... 333/206; 333/207; 333/222; 333/223

(58) Field of Classification Search ..... 333/206, 333/207, 222, 223
See application file for complete search history.

(56) References Cited

U.S. PATENT DOCUMENTS 3,882,434 A * 5/1975 Levy ..... 333/212
4,360,793 A * 11/1982 Rhodes et al. ..... 333/212
4,725,798 A * 2/1988 Igarashi ..... 333/212
5,113,310 A * 5/1992 Kuroki et al. ..... 361/302
5,365,209 A * 11/1994 Ito et al. ..... 333/202
6,075,975 A * 6/2000 Yorita ..... 455/83
6,081,174 A * 6/2000 Takei et al. ..... 333/206
6,133,808 A * 10/2000 Arakawa ..... 333/134
6,262,639 B1 * 7/2001 Shu et al. ..... 333/202
6,566,986 B2 * 5/2003 Sano et al. ..... 333/202

FOREIGN PATENT DOCUMENTS

CN 3643251 5/2007
JP 02050502 * 2/1990

* cited by examiner

*Primary Examiner*—Benny Lee
*Assistant Examiner*—Kimberly E Glenn
(74) *Attorney, Agent, or Firm*—Oliff & Berridge, PLC

(57) ABSTRACT

A stable and reliable built-in cross-coupled dielectric filter with temperature-independent performances and improved rectangular degree and amplitude-frequency characteristic is disclosed. The built-in cross-coupled dielectric filter comprises at least three sequentially welded coaxial dielectric resonators. Mutually coupled capacitors or mutually coupled inductors are etched on the two adjacent lateral surfaces of the adjacent coaxial dielectric resonators, respectively, with an alternate setup. The input and output ports of the built-in cross-coupled dielectric filter are positioned at the two coaxial dielectric resonators at the head and tail, respectively. The present invention is particularly applicable to the high-frequency realm such as microwave.

2 Claims, 1 Drawing Sheet

BUILT-IN CROSS-COUPLED DIELECTRIC FILTER

FIELD OF THE INVENTION

The present invention relates to a microwave device, and more particularly to a coupled dielectric filter.

BACKGROUND OF THE INVENTION

The prior well-known separate dielectric filter is made from a coaxial dielectric resonator, adopting a low pass prototype, and based on a normalized frequency variable from a calculation and an admittance transformation. A capacitor is manufactured on an alumina ceramic substrate, a pin is installed in a hole of the coaxial dielectric resonator and connected with the capacitor, and thus a band-pass dielectric filter is obtained. It has four great shortcomings resulted from the structure of separate dielectric filter: First, the separate dielectric filter adopts an exterior dielectric coupling, which results in a poor reliability, and makes the capacitor and a terminal of the coaxial dielectric resonator easy to fall off. Second, for an increased number of levels, the ceramic-substrated capacitor will have to be lengthened, and is thus very easy to become ruptured during transportation, installation and decline, causing a poor contact. Third, temperature drift of the ceramic substrate as the capacitor substrate at high and low temperatures, due to temperature characteristics of the ceramic substrate, highly tends to result in performance deterioration of the filter. Fourth, since mutual influence of electromagnetic field between all levels of exterior coupling at high frequencies (such as frequencies above 3G) is very strong, it is very difficult to give attention to all levels of coupling, and thus difficult to produce a high-quality filter.

CONTENTS OF THE INVENTION

The technical goal that the present invention intends to achieve is to provide a stable and reliable filter with temperature-independent performances and improved rectangular degree and amplitude-frequency characteristic.

The technical solution of the present invention is as below in order to achieve the technical goal: A built-in cross-coupled dielectric filter is provided that comprises at least three sequentially welded coaxial dielectric resonators; mutually coupled capacitors or mutually coupled inductors are etched on the two adjacent lateral surfaces of the adjacent coaxial dielectric resonators, respectively, with an alternate setup; and the input and output ports of the built-in cross-coupled dielectric filter are positioned at the two coaxial dielectric resonators at the head and tail, respectively.

The mutually coupled capacitors are made by etching mutually-matched open-loop grooves on the two adjacent lateral surfaces of the adjacent coaxial dielectric resonators. The mutually coupled inductors are made by etching mutually-matched straight-line grooves on the two adjacent lateral surfaces of the adjacent coaxial dielectric resonators.

The open-loop groove is a rectangular groove with an open top.

The input and output ports are coated with the polytetrafluoroethylene material.

The beneficial effect of the present invention is as below: Achieving the coupling between the coaxial dielectric resonators by adopting the cross coupling between the built-in capacitors and inductors, the present invention effectively solves the reliability and stability problems at high and low temperatures, and significantly improves the rectangle degree and amplitude-frequency characteristic of the filter.

DETAILED DESCRIPTION OF THE EMBODIMENTS

A further description of the present invention will be given below according to the drawings. However, the present invention should not be limited to this embodiment only.

Figure 1:
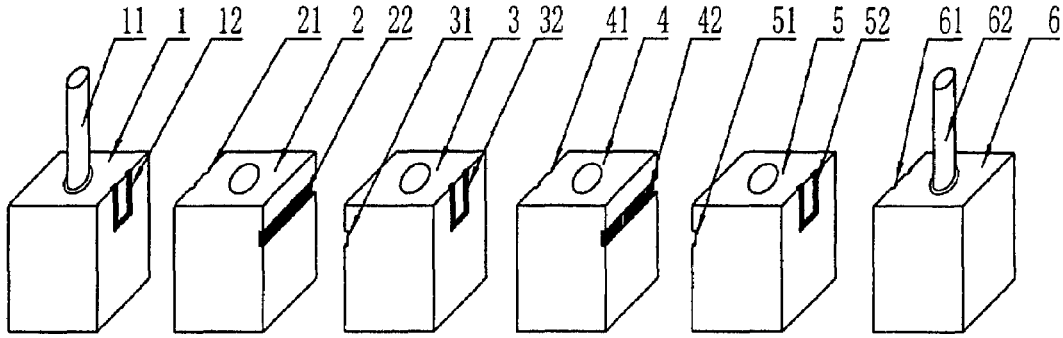
FIG. 1 is a schematic view of the structure principle of the present invention.
Figure 2:
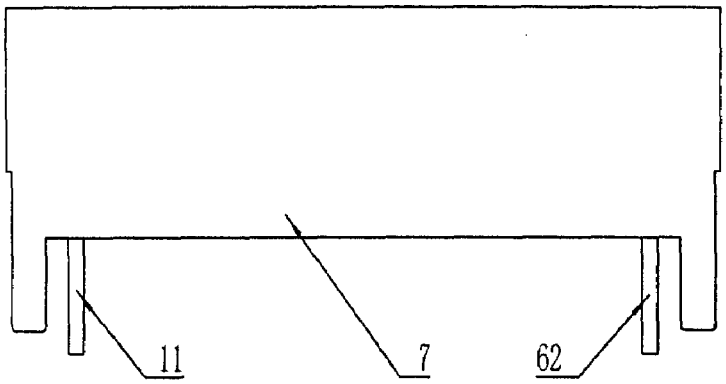
FIG. 2 is a front outside view of the present invention.

As shown in FIG. 1, the built-in cross-coupled dielectric filter in the embodiment comprises the six sequentially welded coaxial dielectric resonators, coaxial dielectric resonator 1, coaxial dielectric resonator 2, coaxial dielectric resonator 3, coaxial dielectric resonator 4, coaxial dielectric resonator 5 and coaxial dielectric resonator 6; the mutually-coupled open-top rectangular grooves 12 and 21 are etched on the adjacent lateral surfaces of the coaxial dielectric resonator 1 and the coaxial dielectric resonator 2, respectively; the mutually-coupled straight-line grooves 22 and 31 are etched on the adjacent lateral surfaces of the coaxial dielectric resonator 2 and the coaxial dielectric resonator 3, respectively; the mutually-coupled open-top rectangular grooves 32 and 41 are etched on the adjacent lateral surfaces of the coaxial dielectric resonator 3 and the coaxial dielectric resonator 4, respectively; the mutually-coupled straight-line grooves 42 and 51 are etched on the adjacent lateral surfaces of the coaxial dielectric resonator 4 and the coaxial dielectric resonator 5, respectively; the mutually-coupled open-top rectangular grooves 52 and 61 are etched on the adjacent lateral surfaces of the coaxial dielectric resonator 5 and the coaxial dielectric resonator 6, respectively; the two adjacent mutually-matched open-top rectangular grooves together constitute the coupled capacitors, with the capacitance determined by the size of the area enclosed by the open-top rectangular groove; the two adjacent mutually-matched straight-line grooves together constitute the coupled inductors, with the inductance determined by the cross-sectional area of the straight-line groove; the coaxial dielectric resonator 1 is provided with the input port 11 of the built-in cross-coupled dielectric filter, and the coaxial dielectric resonator 6 with the output port 62 of the built-in cross-coupled dielectric filter; the input port 11 and output port 62 are coated with the polytetrafluoroethylene material; during the actual manufacturing process, the size of the area enclosed by the etched open-top rectangular groove can be adjusted according to the actual capacitance requirement, and the cross-sectional area of the etched straight-line groove adjusted according to the actual inductance requirement. As shown in FIG. 2, during the actual manufacturing process, the number of the coaxial dielectric resonators can be determined according to the actual situation, and the built-in cross-coupled dielectric filter of the present invention is case-packaged by the silver-plated copper plate 7. Moreover, the open-loop groove can also be of other shapes of grooves such as a U-form one besides the open-top rectangular groove.

The invention claimed is:

1. A built-in cross-coupled dielectric filter comprising:

at least three sequentially welded coaxial dielectric resonators;

mutually coupled capacitors or mutually coupled inductors etched on pairs of opposing lateral surfaces of adjacent coaxial dielectric resonators such that consecutive pairs of opposing lateral surfaces of adjacent coaxial dielectric resonators have mutually coupled inductors and mutually coupled capacitors etched thereon in an alternating manner; and an input port and an output port of the built-in cross-coupled dielectric filter are positioned at a first coaxial dielectric resonator and a last coaxial dielectric resonator, respectively, wherein the mutually coupled capacitors are formed by etching mutually-matched open-loop grooves on the opposing lateral surfaces of the adjacent coaxial dielectric resonators, and the mutually coupled inductors are formed by etching mutually-matched straight-line grooves on the opposing lateral surfaces of the adjacent coaxial dielectric resonators.

2. The built-in cross-coupled dielectric filter according to claim 1, wherein the open-loop groove is a rectangular groove with an open top.

* * * * *